US011287194B2

(12) United States Patent
Wang et al.

(10) Patent No.: US 11,287,194 B2
(45) Date of Patent: Mar. 29, 2022

(54) GAS-GAS HIGH-TEMPERATURE HEAT EXCHANGER

(71) Applicant: XI'AN JIAOTONG UNIVERSITY, Xi'an (CN)

(72) Inventors: Qiuwang Wang, Xi'an (CN); Pan Zhang, Xi'an (CN); Ting Ma, Xi'an (CN)

(73) Assignee: XI'AN JIAOTONG UNIVERSITY, Shaanxi (CN)

( * ) Notice: Subject to any disclaimer, the term of this patent is extended or adjusted under 35 U.S.C. 154(b) by 133 days.

(21) Appl. No.: 16/632,382

(22) PCT Filed: Aug. 2, 2017

(86) PCT No.: PCT/CN2017/095548
§ 371 (c)(1),
(2) Date: Jun. 4, 2020

(87) PCT Pub. No.: WO2019/019205
PCT Pub. Date: Jan. 31, 2019

(65) Prior Publication Data

US 2020/0300559 A1 Sep. 24, 2020

(30) Foreign Application Priority Data

Jul. 26, 2017 (CN) ..... 201710615447.3

(51) Int. Cl.
*F28D 7/00* (2006.01)
*F28F 1/42* (2006.01)
(Continued)

(52) U.S. Cl.
CPC ..... *F28F 1/42* (2013.01); *F28D 7/0066* (2013.01); *F28D 7/106* (2013.01); *F28F 9/24* (2013.01);
(Continued)

(58) Field of Classification Search
CPC ..... F28D 7/10; F28D 7/103; F28D 7/106; F28D 7/16; F28D 7/0066; F28F 13/12; F28F 2215/04
See application file for complete search history.

(56) References Cited

U.S. PATENT DOCUMENTS 1,814,011 A * 7/1931 Snow ..... F28D 7/0066 165/159
1,853,684 A * 4/1932 Jacobus ..... F28D 7/00 165/143
(Continued)

FOREIGN PATENT DOCUMENTS

CN 202902839 U 4/2013
CN 103712495 A 4/2014
(Continued)

*Primary Examiner* — Eric S Ruppert

(57) ABSTRACT

The present discloses a gas-gas high-temperature heat exchanger, including a shell (12), a tube sheet (5), a low-temperature gas inlet pipeline (6) and an outlet pipeline (7), and a high temperature gas outlet (8), the tube is divided into a first heat transfer zone (1) and a second heat transfer zone (2), a low temperature gas (4) flows in the tube, the tube includes a insert component (9) and an outer fin (10); a heat transfer tube in the second heat transfer zone (2) has a sleeve structure, a high-temperature gas (3) flows in the core tube (13), the low temperature gas (4) flows in an annular region between the core tube (13) and an outer tube (14), the high-temperature gas (3) flows out of the core tube (13) and flows into the shell-side area of the second heat transfer zone (2) again.

11 Claims, 2 Drawing Sheets

(51) Int. Cl.
*F28F 9/24* (2006.01)
*F28D 7/10* (2006.01)

(52) U.S. Cl.
CPC ..... *F28D 7/0016* (2013.01); *F28F 2215/04* (2013.01); *F28F 2270/00* (2013.01); *F28F 2270/02* (2013.01)

(56) References Cited

U.S. PATENT DOCUMENTS

| | | | | | |
|---|---|---|---|---|---|
| 2,079,144 | A * | 5/1937 | Appa | F28F 13/12 | 138/38 |
| 2,633,338 | A * | 3/1953 | Hiersch | F28D 7/106 | 165/143 |
| 4,049,051 | A * | 9/1977 | Parker | F28F 3/027 | 165/166 |
| 4,477,019 | A | 10/1984 | Breitbach | | |
| 2016/0046820 | A1 * | 2/2016 | He | B05D 3/002 | 165/10 |

FOREIGN PATENT DOCUMENTS

| | | | | |
|---|---|---|---|---|
| CN | 205192294 | U | 4/2016 | |
| CN | 105571356 | A | 5/2016 | |
| DE | 3215780 | A1 * | 11/1983 | F28D 7/0075 |
| GB | 1097599 | A * | 1/1968 | F28F 9/06 |
| NL | 185228 | C | 2/1990 | |
| SU | 486958 | A1 * | 10/1975 | |

* cited by examiner

GAS-GAS HIGH-TEMPERATURE HEAT EXCHANGER

CROSS REFERENCES TO RELATED APPLICATIONS

This is a Sect. 371 National Stage of a PCT International Application No. PCT/CN2017/095548, filed on Aug. 2, 2017, which claims priority to a Chinese Patent Application No. CN 2017106154473, entitled "Gas-Gas High-Temperature Heat Exchanger", filed with CNIPO on Jul. 26, 2017, the contents of which are incorporated herein by reference in its entirety.

TECHNICAL FIELD

The present disclosure relates to a shell-and-tube heat exchanger which can be used in the fields of metallurgy, chemical industry, energy and waste incineration, and can withstand high temperature, in particular, relates to a gas-gas high-temperature heat exchanger.

BACKGROUND

In recent years, the working temperature and pressure of heat exchangers have become higher and higher. For example, the working temperature of heat exchangers in industrial application, such as sulfur-iodine thermo-chemical hydrogen production, ethylene cracking, and ammonia synthesis, is often higher than 1000° C. These production processes require high-temperature resistant, high-pressure resistant, and corrosion resistant heat exchangers to ensure efficiency and safety of production.

For shell-and-tube heat exchangers with gas participating in heat transfer, heat transfer is usually enhanced by using fins on the inner and outer wall surfaces of the tubes. In recent years, scholars have proposed to use the structure of the inner and outer finned tubes for heat transfer enhancement. The inner and outer finned tubes have a large heat transfer area, which improves the heat transfer capacity of the heat exchanger.

However, there are some problems with the current inner and outer finned tube heat exchangers. On one hand, the inner and outer fins will increase the temperature of the tube wall while strengthening the heat transfer of the heat exchanger. For the heat transfer at high temperature, the excessively high temperature of the tube wall will greatly increase the difficulty and cost for welding the fins. The inner fins are usually bonded to the inner wall surfaces of the tubes by brazing, excessively high temperature of wall surface will greatly reduce the adhesion of the fins to the tube wall surfaces, even separate from the inner wall surfaces of the tubes, which will reduce the heat transfer performance of the heat exchanger, therefore the heat exchanger is not efficient and stable. On the other hand, compared with smooth tubes, inner and outer finned tubes greatly increase the flow resistance of the fluid on both sides and in turn increase power consumption. Meanwhile, when the high temperature gas contains dust, the outer fins may be accumulated with ash and clogged.

SUMMARY

The present disclosure provides a gas-gas high-temperature heat exchanger. Enhanced heat exchanger structures are disposed in different temperature zones of the heat exchanger, to achieve the cascade utilization of heat, thereby reducing the temperature of the tube wall and avoiding the problem of high temperature welding of the inner fins, reducing the difficulty and cost of the inner fins welding, decreasing the flow resistance on both sides. The heat exchanger according to the present disclosure has better heat transfer performance and stability than those of common shell-and-tube heat exchangers.

The technical solution of the present disclosure is described as follows.

A gas-gas high-temperature heat exchanger, including a shell, and a tube sheet, a low-temperature gas inlet pipeline and an outlet pipeline, and a high temperature gas outlet pipeline, the heat exchanger is divided into a first heat transfer zone and a second heat transfer zone, gas flow directions on both sides of the first heat transfer zone are cross-flowing, the low temperature gas flows in the tube, the tube includes an insert component inside the tube, and includes an outer fin outside the tube; a heat transfer tube in the second heat transfer zone has a sleeve structure, a high-temperature gas flows in the core tube, the low temperature gas flows in an annular region between the core tube and an outer tube, the high-temperature gas and the low-temperature gas has opposite flow directions, the high-temperature gas flows out of the core tube and flows into the shell-side area of the second heat transfer zone again, the high-temperature gas in the shell-side area of the second heat transfer area has a flow direction cross with that of the low-temperature gas, the core tube includes an insert component, the annular area includes inner fins.

The high-temperature gas is high-temperature flue gas, the low-temperature gas is air, the high-temperature gas sequentially flows through the shell side of the first heat transfer zone, the tube side of the second heat transfer zone, and the shell side of the second heat transfer zone, and the low-temperature gas flows through the tube side of the second heat transfer zone and the tube side of the first heat transfer zone.

The heat transfer tube in the second heat transfer zone includes fins or does not include fins outside the heat transfer tubes.

When the temperature of the high-temperature gas is low, the first heat transfer zone includes one tube pass, when the temperature of the high-temperature gas is high, the first heat transfer zone includes a plurality of tube passes.

The number of longitudinal corrugations on the inner fin gradually increases along the flow direction of the low temperature gas.

The heat transfer tube, the outer fin, and the insert component in the first heat transfer zone are made of high-temperature resistant materials; the outer tube, the core tube, the inner fin and the insert component in the second heat transfer zone are made of common materials; and the surface of the tube sheet, and the inner wall of the shell structure includes insulation layer.

The inner fin is longitudinal corrugated fin or longitudinal straight fin.

The inner fin includes a hole or a slit.

The outer fin is H-shaped fin, circular fin, or integrated fin.

The outer fin includes a hole, a slit, a longitudinal vortex generator, or shutter.

The insert component is an inserter with twisted tape-shaped.

The insert component includes a hole, a slit or an airfoil structure.

The present disclosure has the following advantages.

① Improving heat transfer efficiency. Different heat transfer structures are disposed in different temperature zones of the heat exchanger, and heat of high-temperature gases at different temperatures are recovered, which achieves the cascade utilization of heat, and effectively improves the total heat transfer capacity and heat transfer efficiency.

② Reducing the wall temperature of the heat exchanger. The insert component is disposed in the tube of the first heat transfer zone. The heat exchanger has high thermal stability and avoids the high temperature welding of the internal fins, while the temperature of the high-temperature gas is significantly reduced by the enhanced heat transfer effect on both sides, thereby reducing the wall temperature of the second heat transfer zone. The fins at the front part of the second heat transfer zone are sparse, and the fins at the back part of the second heat transfer zone are dense, therefore the ratio of the thermal resistance inside and outside the core tube at different temperature zones can be adjusted, the wall temperature is reduced, the difficulty and the cost of fin welding are reduced, and the stable operation of the inner fin in ensured.

③ Reducing flow resistance. The inner fins in the tubes of the first heat transfer zone and the core tubes of the second heat transfer zone are replace with the insert components, which increases the flow cross area, reduces the flow velocity of the working fluid, thereby reducing resistance force and saving power consumption.

Reducing manufacturing costs. The second heat transfer zone of the heat exchanger is made of common material, which reduces the amount of high temperature resistant materials and saves the cost.

In summary, the present disclosure has the following advantages.

① The present disclosure can improve the heat transfer efficiency and compactness of the high temperature heat exchanger.

② The present disclosure can reduce the wall temperature of the high-temperature heat exchanger, increase the tolerance temperature of the heat exchanger, and can extend the working life of the heat exchanger.

③ The present disclosure can reduce the flow resistance of the heat exchanger and improve the comprehensive performance of the heat exchanger.

④ The present disclosure can reduce the manufacture cost of the heat exchanger.

BRIEF DESCRIPTION OF THE DRAWINGS

FIG. 2 (*b*) is a schematic diagram of a heat transfer tube in the first heat transfer zone of the present disclosure.

DETAILED DESCRIPTION OF THE PREFERRED EMBODIMENTS

The present disclosure is described in detail below with reference to the drawings and specific embodiments.

A gas-gas high-temperature heat exchanger includes a shell, a tube sheet, a low-temperature gas inlet pipeline and an outlet pipeline, and a high-temperature gas outlet pipelines. The heat exchanger is divided into a first heat exchanger zone and the second heat transfer zone. The gas flowing direction on both sides of the first heat transfer zone is cross-flowing. The low temperature gas flows in the tube, the tube includes insert components, fins are installed outside the tube. The heat transfer tube in the second heat transfer zone has sleeve structure. High-temperature gas flows in the core tube, low-temperature gas flows in the annular area between the core tube and the outer tube. The high-temperature gas and low-temperature gas has opposite flow directions. The high-temperature gas flows out of the core tube and flows into the shell-side area of the second heat transfer zone. The high-temperature gas in the shell-side of the second heat transfer zone has a flow direction cross with that of the low-temperature gas. The core tube includes insert components. The fins at the front part of the annular area are sparse, and the fins at the back part of the annular area are dense. The high temperature gas flows into the heat exchanger from one side of the first heat transfer zone, and sequentially flow through the shell side of the first heat transfer zone, the tube side of the second heat transfer zone, and the shell side of the second heat transfer zone, then transfers heat to the low temperature gas.

The present disclosure can utilize the heat efficiently, improve the heat transfer efficiency of the heat exchanger, significantly reduce the wall surface temperature of the heat exchanger, improve the high temperature resistance performance of the heat exchanger, reduce the manufacturing cost of the high temperature heat exchanger, and be used in high temperature environments.

Figure 1:
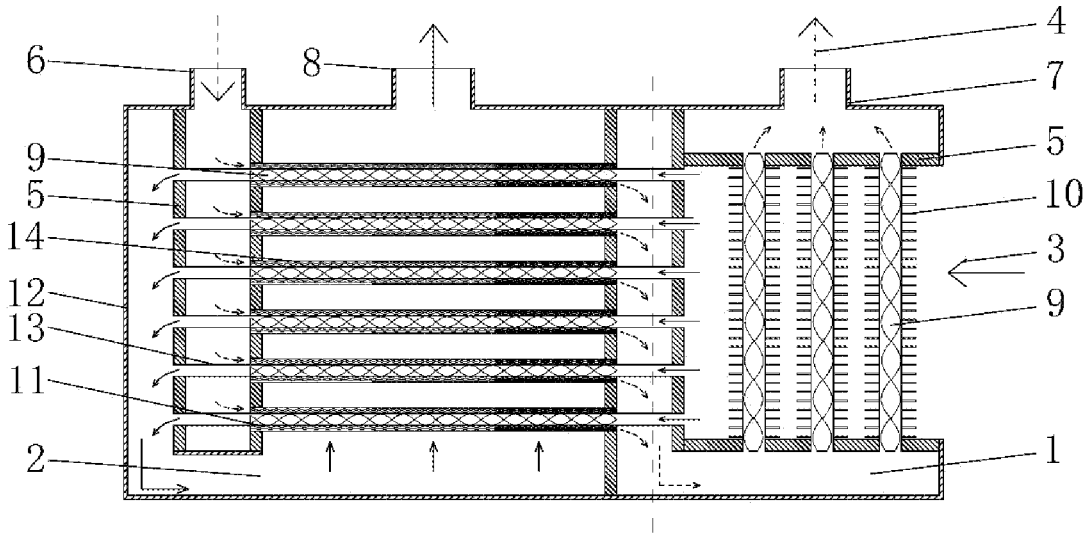
FIG. 1 is a schematic diagram of the high-temperature heat exchanger of the present disclosure.

As shown in FIG. 1, a gas-gas high-temperature heat exchanger includes a shell structure 12. A tube plate 5, a low-temperature gas inlet pipeline 6 and an outlet pipeline 7, and a high temperature gas outlet 8 are connected to the shell 12. The heat exchanger is divided into a first heat transfer zone 1 and a second heat transfer zone 2. The high temperature gas 3 is high-temperature flue gas as the heat source in the heat exchanger. The high temperature gas 3 flows sequentially through the shell side of the first heat transfer zone 1, the tube side of the second heat transfer zone 2, and the shell side of the second heat transfer zone 2, then flows out of the heat exchanger from the outlet pipeline 8. The low-temperature gas 4 is air, flows sequentially through the tube side of the second heat transfer zone 2 and the tube side of the first heat transfer zone 1, and then flows out of the heat exchanger from the outlet pipeline 7. The flow direction of the fluid on both sides of the first heat transfer zone 1 is cross-flowing.

The tube includes insert components 9. Fins 10 are installed outside the tube. The insert component 9 has high thermal stability. The insert components 9 are used to replace the inner fins in the traditional inner and outer finned tube, thereby avoiding the hazards caused by the high temperature welding of the inner fins, and overcoming the disadvantage of high flow resistance in the tube. The enhanced heat transfer of the two sides of the heat transfer tubes in the first heat transfer zone 1 significantly reduces the temperature of the high-temperature gas 3 flowing through, thereby reducing the wall surface temperature of the heat transfer tube in the second heat transfer zone 2.

The heat transfer tube in the second heat transfer zone 2 has a sleeve structure. The high-temperature gas 3 flows in the core tube 13, and the low-temperature gas 4 flows in the annular area between the core tube 13 and the outer tube 14. The high-temperature gas and low-temperature gas has opposite flow directions. The core tube 13 of the heat transfer tube includes insert components 9. The inner fins 11 are installed in the annular area between the core tube 13 and the outer tube. The inner fins 11 can significantly increase the heat transfer area and enhance the fluid disturbance.

The heat is transferred from the high-temperature gas 3 to the low-temperature gas 4 through the enhanced heat transfer on both sides. The high temperature gas 1 flows out from the core tube 13, flows into the second heat transfer zone 2 again to heat the low-temperature gas 4. The high-temperature gas in the second heat transfer zone has a flow direction cross with that of the low-temperature gas 4. The heat transfer tubes in the second heat transfer zone 2 do not have fins on the outer side, which can significantly reduce the wall temperature, and increase the life of the inner fins 13 and the heat exchanger.

When the temperature of the wall surface of the heat transfer tube in the heat transfer zone 2 is far lower than the critical temperature for welding the inner fins 11, outer fins may be installed outside the heat transfer tube in the second heat transfer zone 2, so as to further improve the heat transfer efficiency of the heat exchanger. The number of longitudinal corrugations on the inner fin 11 gradually increases along the flow direction of the low temperature gas 4, so that the temperature of the core tube wall can be reduced by adjusting the thermal resistance ratios of the inner side of the core tube to the outer side of the core tube in different regions. In this way, the difficulty and the cost for welding the fins 11 are greatly reduced, thereby ensuring the safety for welding the inner fin 11.

When the temperature of the high-temperature gas 3 is low or the heat transfer requirement is weak, the first heat transfer zone 1 only needs one tube pass to complete the heat transfer task. When the temperature of the high-temperature gas 3 is high or the heat transfer requirement is strong, the first heat transfer zone 1 needs more than one tube passes to fully utilize the heat of the high temperature flue gas, and improve the heat transfer efficiency of the heat exchanger.

The heat transfer tubes, outer fins 10, and insert components 9 in the first heat transfer zone 1 are made of high-temperature resistant materials. The outer tubes 14, core tubes 13, inner fins 11, and insert components 9 in the second heat transfer zone are made of common materials, so as to reduce costs. Heat insulation layers are disposed on the surface of the tube sheet 5, and the inner wall of the shell structure 12 to avoid heat dissipation and consumption.

Figure 2:
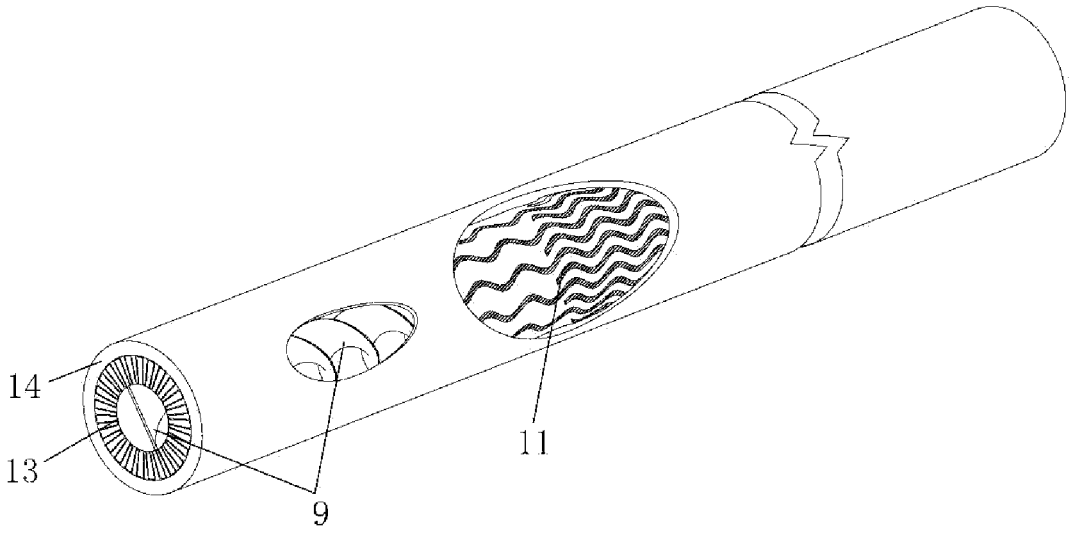
FIG. 2 (*a*) is a schematic diagram of a heat transfer tube in the second heat transfer zone of the present disclosure.
Figure 2:
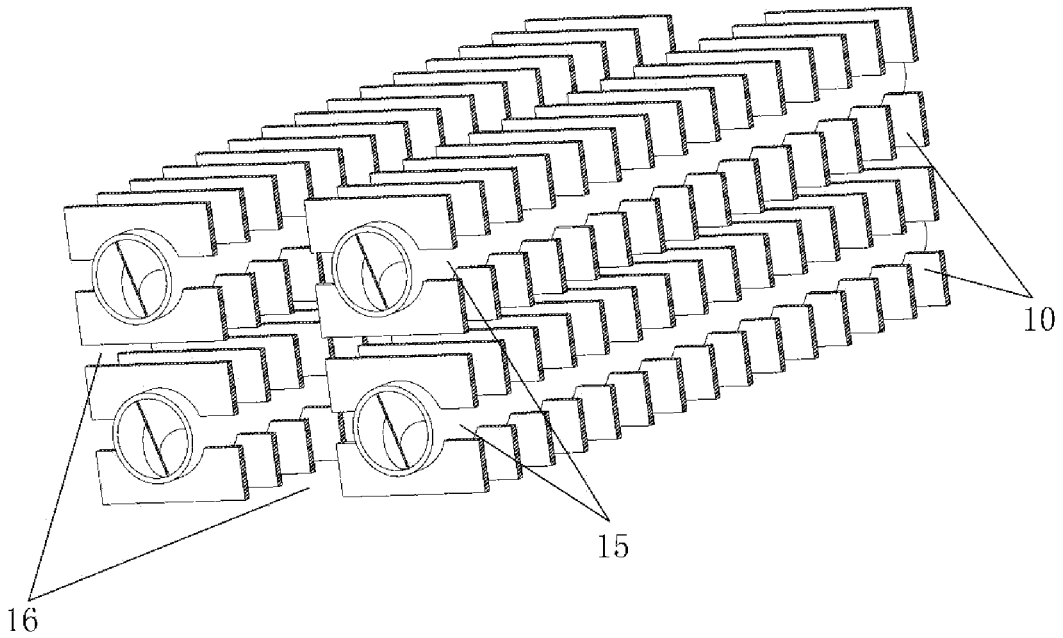

As shown in FIG. 2 (*a*), the heat transfer tube has a sleeve structure. The core tube 13 is sleeved inside the outer tube 14. The core tube 13 includes insert components 9. The insert components 9 are welded to the core tube 13 at both ends of the tube. The part of the insert component 9 in the tube is not connected to the core tube 13. The annular region between the core tube 13 and the outer tube 14 has longitudinal corrugated inner fin 11. The inner fin 11 is welded to the inner wall of the outer tube 14 and is not connected to the outer wall of the tube 13. The number of longitudinal corrugations of the inner fin 11 gradually increases along the flow direction of the fluid. The inner fin 11 and the insert component 9 may have holes or slits to further enhance heat transfer.

As shown in FIG. 2 (*b*), the H-type outer fins 10 are symmetrically and uniformly fixed on the outer wall of the smooth tube. An empty groove 15 is disposed between two fins on the same tube in the flowing direction. A gap 16 is disposed between the fins on the adjacent tube. The inner fin 11 may have holes, slits, longitudinal vortex generators, or shutters to further enhance heat transfer.

INDUSTRIAL PRACTICABILITY

The gas-gas high-temperature heat exchanger of the present disclosure can be manufactured or used in industry, thus has industrial practicability.

The invention claimed is:

1. A gas-gas high-temperature heat exchanger, comprising a shell (12), a tube plate (5), a low-temperature gas inlet pipeline (6) and an outlet pipeline (7), and a high-temperature gas outlet (8), wherein the gas-gas high-temperature heat exchanger is divided into a first heat transfer zone (1) and a second heat transfer zone (2), a high-temperature gas (3) and a low-temperature gas (4) in the first heat transfer zone (1) are cross-flowing, a first-zone tube is disposed in the first heat transfer zone (1), the low-temperature gas (4) flows in the first-zone tube, the first-zone tube includes a first insert component (9) inside the first-zone tube and an outer fin (10) outside the first-zone tube;

a sleeve structure is disposed in the second heat transfer zone (2), wherein the sleeve structure includes a core tube (13) and an outer tube (14) disposed outside the core tube (13), and an annular region is disposed between the core tube (13) and an outer tube (14), the high-temperature gas (3) flows in the core tube (13), the low-temperature gas (4) flows in the annular region, a flow direction of the high-temperature gas (3) flowing in the core tube (3) is opposite to a flow direction of the low-temperature gas (4) flowing in the annular region, the high-temperature gas (3) flows out of the core tube (13) and flows into a shell-side area of the second heat transfer zone (2), the high-temperature gas (3) in the shell-side area of the second heat transfer zone has a flow direction cross with that of the low-temperature gas (4), and the core tube (13) includes a second insert component (9), the annular area includes inner fins (11).

2. The gas-gas high-temperature heat exchanger according to claim 1, wherein the high-temperature gas (3) is high-temperature flue gas, the low-temperature gas (4) is air, the high-temperature gas (3) sequentially flows through the first heat transfer zone (1), the core tube (13), and the shell-side of the second heat transfer zone (2), and the low-temperature gas (4) flows through the annular region in the second heat transfer zone (2) and the first-zone tube in the first heat transfer zone (1).

3. The gas-gas high-temperature heat exchanger according to claim 1, wherein the outer tube (14) in the second heat transfer zone (2) includes fins outside the outer tube (14).

4. The gas-gas high-temperature heat exchanger according to claim 1, wherein the number of longitudinal corrugations on the inner fins (11) gradually increases along the flow direction of the low-temperature gas (4).

5. The gas-gas high-temperature heat exchanger according to claim 1, wherein a surface of the tube plate (5), and an inner wall of the shell (12) includes an insulation layer.

6. The gas-gas high-temperature heat exchanger according to claim 1, wherein the inner fins (11) have a corrugated shape or straight shape.

7. The gas-gas high-temperature heat exchanger according to claim 1, wherein the inner fins (11) includes a hole or a slit.

8. The gas-gas high-temperature heat exchanger according to claim 1, wherein the outer fin (10) is H-type fin, circular fin, or integrated fin.

9. The gas-gas high-temperature heat exchanger according to claim 1, wherein the outer fin (10) includes a hole, a slit, a longitudinal vortex generator, or shutter.

10. The gas-gas high-temperature heat exchanger according to claim 1, wherein the first insert component (9) and the second insert component (9) have a twisted tape shape, and are inserted in the first-zone tube and the core tube (13), respectively.

11. The gas-gas high-temperature heat exchanger according to claim 1, wherein the first insert component (9) and the second insert component (9) include a hole, a slit or an airfoil structure.

* * * * *